United States Patent [19]

Horii

[11] Patent Number: 4,630,933

[45] Date of Patent: Dec. 23, 1986

[54] ELECTRICALLY OPERATED CLOCK AND SHAVER COMBINATION

[75] Inventor: Sadashige Horii, Hikone, Japan

[73] Assignee: Matsushita Electric Works, Ltd., Japan

[21] Appl. No.: 835,784

[22] Filed: Mar. 3, 1986

[30] Foreign Application Priority Data

Mar. 20, 1985 [JP] Japan ..... 60-56597

[51] Int. Cl.[4] ..... G04B 47/00; B26B 19/28

[52] U.S. Cl. ..... 368/10; 368/278; 30/45

[58] Field of Search ..... 368/10, 276–278; 30/45

[56] References Cited

U.S. PATENT DOCUMENTS 3,783,364 1/1974 Gallanis ..... 368/10

FOREIGN PATENT DOCUMENTS 57-38273 8/1982 Japan .

*Primary Examiner*—Vit W. Miska

*Attorney, Agent, or Firm*—Stevens, Davis, Miller & Mosher

[57] ABSTRACT

A clock and shaver combination unit comprises a casing provided with an electric clock and a battery source therefor and a self-contained battery powered electric shaver removably received in a compartment in the casing. The shaver is in use to be removed from the casing and utilized separately from the clock, while it can be held in the clock casing when the shaver is not in use. This permits the user to always look at the time while his is shaving, yet enabling the user to carry the shaver together with the clock as one integral unit.

9 Claims, 16 Drawing Figures

ELECTRICALLY OPERATED CLOCK AND SHAVER COMBINATION

BACKGROUND OF THE INVENTION

1. Field of the Invention

The present invention is directed to an electrically operated clock and shaver combination, and more particularly to such a combination unit which includes a casing mounting thereon the electric clock and having a compartment for detachably receiving therein the electric shaver.

2. Description of the Prior Art

A prior device of like combination has been proposed in Japanese patent publication (KOKOKU) No. P57-38273, in which a clock 3 is fixedly mounted on a shaver housing 1, as reproduced in FIG. 1 of the attached drawings. In this prior device, the clock 3 and the shaver depend on a common battery source to be energized thereby, or they are not electrically isolated from each other. In view of that the shaver requires much more amount of electric power than the clock, the battery will be exhausted much sooner than is expected for the clock alone so that the clock might frequently cease its operation only after a limited number of repeated uses of the shaver. This is inconvenient in that the user who becomes accustomed to an extended life of the conventional electric battery powered clock may possibly overlook the exhaustion of the battery and leave the clock stopped. With this result, the clock operated on the battery common to the shaver is found to be rather unreliable. Alternatively, the prior device is required to include the battery of larger capacity for elongating the operation life of the clock, which induces another problem that the bulk of the shaver is so correspondingly increased as to be inconvenient for handling by the user during the shaving operation. In addition to the above, because of the fixed disposition of the clock on the shaver, the user is difficult to look at the clock during his shaving operation, which will reduce the effect of combining the clock and the shaver and may sometimes frustrate the user in his shaving operation while caring the time.

SUMMARY OF THE INVENTION

In view of the above drawbacks the present invention has been accomplished to provide a useful and unique combination clock and shaver unit which is very convenient for use. The combination unit comprises a casing provided with an electric clock and a battery source therefor and a self-contained battery powered electric shaver detachably received in a compartment formed in said casing. The shaver is in use to be removed from the casing and utilized separately from the clock, while it can be held in the clock casing when the shaver is not in use, which is very convenient in that the user can refer to the clock anytime in his manipulating the shaver and that the shaver and clock can be carried as an integral unit so as to be completely portable. The clock is electrically isolated from the shaver and operates on its own battery source independently of the shaver so that it can have an extended operation life. In another aspect, since the shaver is not required to share its power source with the clock, the shaver is allowed to incorporate the battery source of minimum capacity required for its shaving operation alone, enabling the shaver to be made compact enough for comfortable use.

Accordingly, it is a primary object of the present invention to provide a combination clock and shaver unit which is completely portable as an integral unit, yet permitting the separate use of the shaver from the clock for enhancing the convenience of using the shaver as referring to the clock in addition to ensuring an extended operational life of the clock.

The casing is formed in its one side end with an entrance opening through which the shaver is inserted into the compartment. Formed in the compartment wall is a slot which catches a switch handle on the shaver so as to retain it in its inoperative or off position when the shaver is inserted into the compartment. Thus, the shaver is prevented from being accidentally turned on when it is received in the casing.

It is therefore another object of the present invention to provide a combination clock and shaver unit which includes a safe guard scheme against an accidental energization of the shaver while it is held in the casing. Attached to the casing is a telescopic stand for placing the casing on a table or the like supporting surface. The stand is pivoted to the casing to be movable between a folded position and an extended position. Thus, the casing can be placed on the supporting surface at a desired angular disposition by adjusting the length of the telescopic stand.

It is therefore a further object of the present invention to provide a combination clock and shaver unit of which casing can be tilted into an optimum angular position with respect to the supporting surface.

The casing includes in its lower portion a battery room with a lid for the battery source of the clock. The lid is arranged in vertically aligned relation with said stand to have its upper edge in closely adjacent relation to the lower edge of the stand in the folded position. A manipulation tab is formed on the upper edge of lid to be caught by a finger of the user which tab extending outwardly and rearwardly of the casing to define between the tab and the lower edge of the folded stand a mouth for easy insertion of the tip of the user's finger, whereby facilitating easy manipulation of the stand into its extended position despite that the lid and the stand are so arranged in closely adjacent relation to each other to leave therebetween substantially no extra space.

In one version of the present invention, a mirror is added to interior of the rear wall of the shaver compartment of the casing. The mirror is viewed through a notched portion of the opposed front wall of the casing so that it can be better utilized by the user in his shaving operation.

In another version, the mirror is added to the front face of the casing for easy reference by the user.

It is therefore a further object of the present invention to provide a combination clock and shaver unit which includes a mirror available in the shaving operation.

In a further version of the present invention, the casing is divided into two sections, one being a clock section including the clock and the battery source therefor, and the other a shaver holding section forming said compartment.

These sections are connected at the side ends thereof through a hinge so that they can assume a folded position where one of the sections is folded on the other and a straight position where they are in alignment relation with each other. With this result, the casing can be folded into a compact configuration and thus occupy little space when packed or stored, which is most suitable for portable purposes. In this instance, the entrance opening of the compartment is formed at the portion of the shaver holding section adjacent to the clock section so as to be closed thereby when the casing is extended to the straight position. Thus, the shaver can be well held within the compartment requiring any closure cap means to be added to the compartment and can be protected from the surrounding dust or the like undesirable foreign matter when the casing is extended to the straight position.

It is therefore a still further object of the present invention to provide a combination clock and shaver unit which can be made compact enough for portable use and as well hold the shaver in the casing without adding any closure cap means to the casing only by extending the casing.

These and the other objects will be more apparent from the following description of the preferred embodiments of the present invention when taken in conjunction with the attached drawings.

DESCRIPTION OF THE PREFERRED EMBODIMENTS

Figure 1:
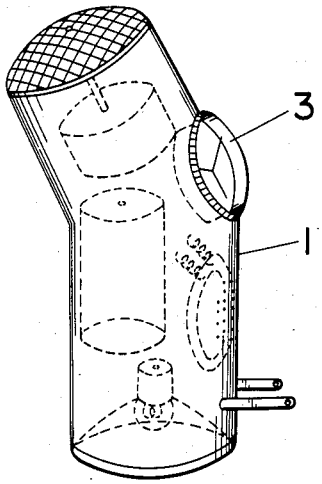
Fig. 1 (PRIOR ART)
FIG. 1 is a perspective of a prior shaver with a clock.
Figure 2:
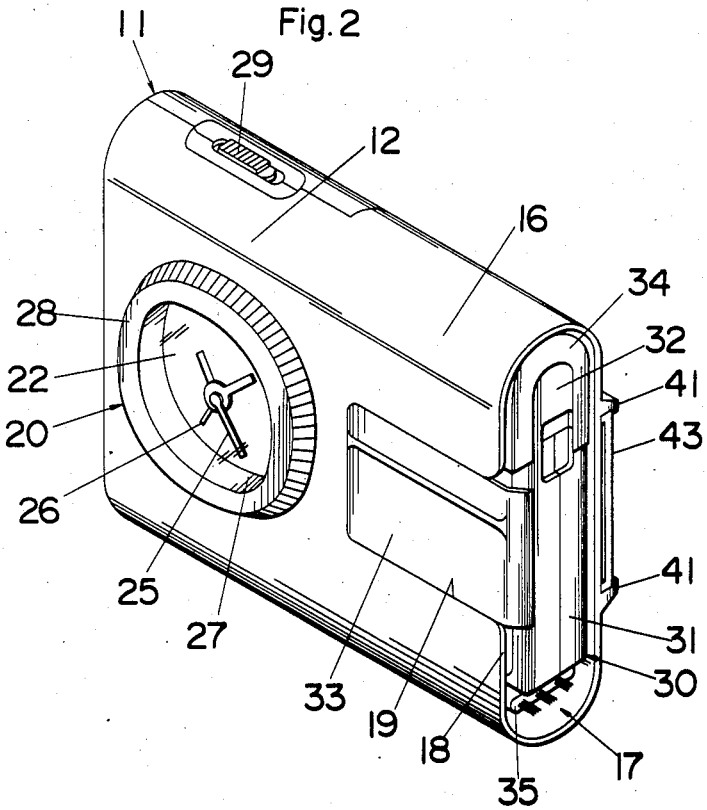
FIG. 2 is a perspective view of a combination clock and shaver unit in accordance with a first embodiment of the present invention.

Referring now to FIGS. 2 to 12, there is disclosed a combination clock and shaver unit in accordance with a first preferred embodiment of the present invention. The combination unit comprises a casing 11 with an electric clock 20 and a self-contained battery powered electric shaver 30 detachably received within a compartment 17 formed in the side half of the casing 11. The casing 11 is made of a plastic material into a generally rectangular flat-shaped enclosure defining a clock section 12 and a shaver holding section 16 with said compartment 17 in such a manner as to arrange the sections in side-by-side relation. That is, the interior of the casing 11 is correspondingly divided by a partition 15 into a clock space 13 and the compartment 17.

The casing 11 is opened at its one side end to define thereat an entrance opening 18 through which the shaver 30 is inserted into the compartment 17.

Figure 10:
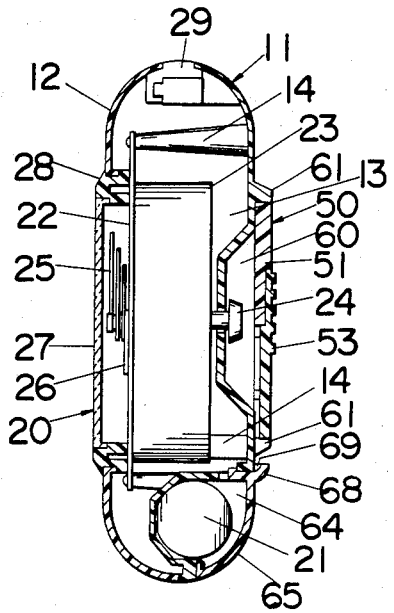
FIG. 10 is a cross section taken along line 10—10 of FIG. 4.

The electric clock 20 operates on its own battery 21 mounted within a battery room 64 in the lower portion of the clock section 12 and is of conventional construction having a face plate 22 with time indicia (not shown) and a clock movement 23 including an electric motor and a manually operable time setting knob 24, as best shown in FIG. 10. The face plate 22 carries on its back the movement 23 and supports a plurality of time indicating shafts which extends therethrough from the movement 23 and on which shafts are secured usual hour, minute and second time indicating hands generally designated by the numeral 25. A usual alarm setting indicator 26 is provided on the face plate 22 to be controlled also by said setting knob 24. The face plate 22 is fixed on integral posts 14 projecting inwardly from the back wall of the casing 11 to be viewed through a transparent plate 27 fitted in the front wall of the clock section 12 of the casing 11, said plate 27 being rotatable and having therearound an integral ring 28 marked with world time indications (not shown). Provided on the top of the clock section 12 is an alarm canceler handle 29 by the manipulation of which an conventional alarm sound generating circuit (not shown) connected thereto is ceased to producing the alarm sound.

Figure 3:
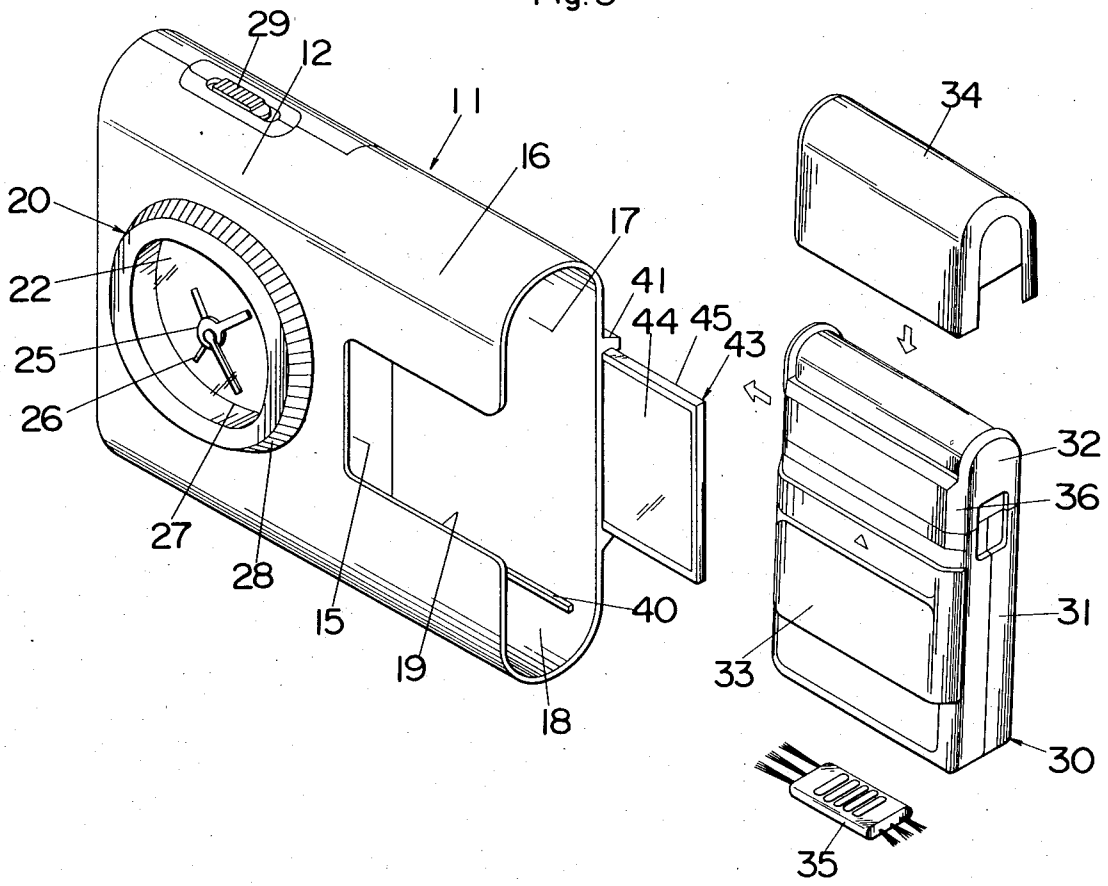
FIG. 3 is an exploded perspective view of the above unit.
Figure 4:
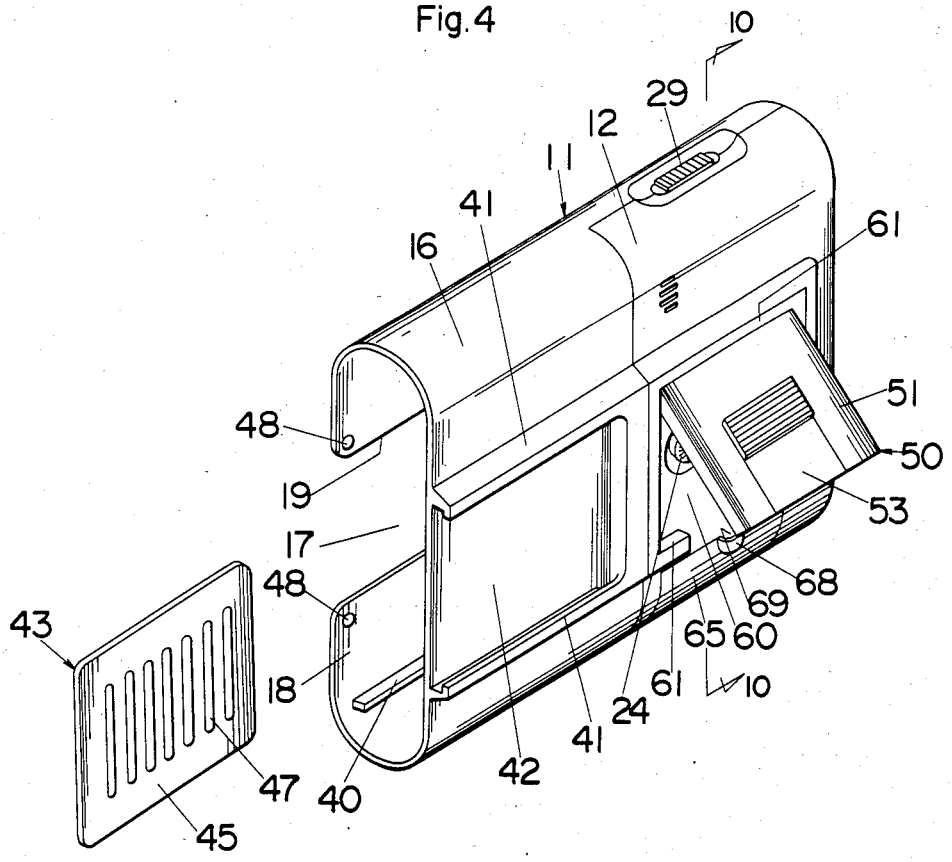
FIG. 4 is a respective view of the above unit with a mirror detached, as viewed from the rear.
Figure 5:
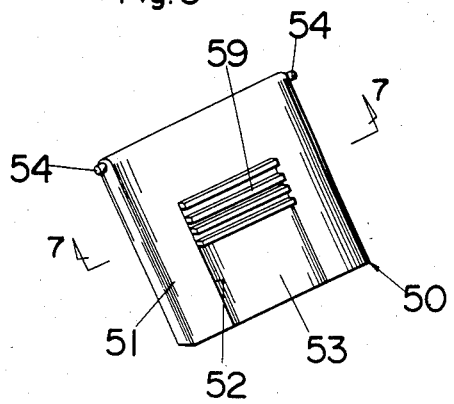
FIG. 5 is a perspective view of a telescopic stand included in the above unit.
Figure 6:
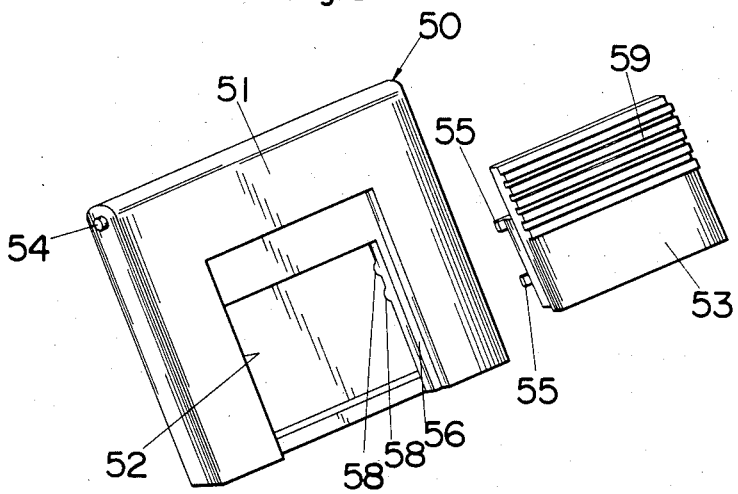
FIG. 6 is an exploded perspective view of the above telescopic stand.
Figure 7:
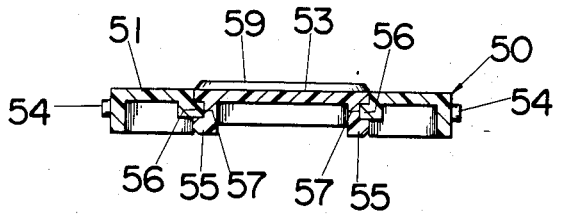
FIG. 7 is a cross section taken along line 7—7 of FIG. 5.
Figure 8:
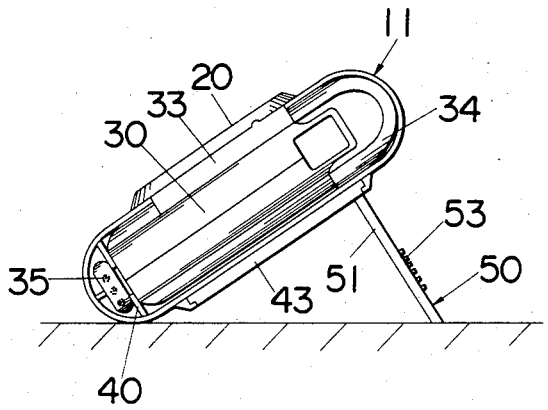
FIGS. 8 and 9 are explanatory views of the above unit supported at differently tilted dispositions, respectively.
Figure 9:
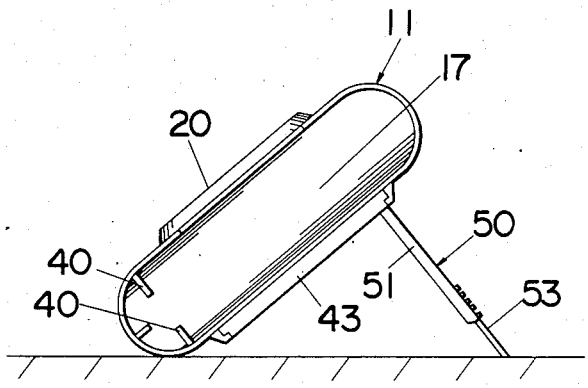

Referring to FIG. 3, the electric shaver 30 is of the conventional type having a cutting head 32 on the top of a shaver housing 31 and operating on an incorporated battery (not shown). The shaver 30 has on the front of its housing 31 a switch handle 33 vertically movable between an on-position and an off-position. The shaver 30, together with a head cover 34 fitted over the cutting head 32, is slidably inserted into said compartment 17 of the casing 11 as its lower end being guided along a pair of lengthwise ribs 40 integrally projecting on the interior of the opposed walls of the shaver holding section 16 in spaced relation from the bottom wall thereof. The top wall of the compartment 17 is rounded to have the curvature corresponding to that of the head cover 34 so that the insertion of the shaver 30 into the compartment 17 can be facilitated by utilizing the rounded top wall as a guide for the head cover 34. Formed on the interior of the front wall of the compartment 17 near the open end thereof are integral nubs 48 which engage with a slanted edge portion 36 of the shaver housing 31 in snapping fashion when the shaver 30 is inserted in the compartment 17 for stably holding the same in position. Said ribs 40 additionally define therebelow in the lower portion of the compartment 17 a small space for receiving an accessory brush 35. The front wall of the compartment 17 is formed with a slot 19 extending to the open end of the casing 11 for receiving therein the switch handle 33 of the shaver 30 in such a way as to lock the switch handle 33 in its off-position, preventing accidental movement of the switch handle 33 into the on-position so long as the shaver 30 is received in the casing 11. As shown in FIGS. 3 and 4, a pair of parallel rails 41 are formed on the outer surface of the rear wall of the compartment 17 to define therebetween a pocket 42 for detachably receiving a mirror assembly 43. The mirror assembly 43 is composed of a mirror-finished film 44 adhered on a base plate 45 with a rim by a suitable adhesive or a double-sided adhesion pad so as to protect the mirror surface from being distorted even if the base plate 45 is stressed when it is tightly inserted between the rails 41. The back surface of the base plate 45 is vertically knurled as at 47 to facilitate gripping. Said clock section 12 includes on its rear wall a telescopic stand 50 for placing the unit on a table or the like supporting surface at different angular dispositions. The stand 50 is pivotally connected to the back of the clock section 12 so as to be movable between a folded position where it is folded into a recess 60 surrounded by an integral flange 61 on the rear wall of the casing 11 and an extended position where it extends angularly away from the casing 11. As shown in FIG. 6, the stand 50 comprises a leg plate 51 with a widened slit 52 and a foot plate 53 slidably received in the slit 52. A pair of pivot pins 54 project on the upper end portion of the leg plate 51 for pivotally connecting it to the flange 61 of the casing 11. The leg plate 51 has a beveled lower edge which is in contact with the supporting surface when the casing 11 is placed thereon with the foot plate 53 retracted to assume a fixed angular position, as shown in FIG. 8. Projecting from either side of the rear surface of the foot plate 53 are a pair of L-shaped hooks 55 by which the foot plate 53 is slidably connected to the leg plate 51. The leg plate 51 includes a pair of parallel tongues 56 extending along the lateral edges of the slit 52, each tongue 56 fitted in a groove 57 defined between the tips of the hooks 55 and the lateral edge of the foot plate 53, as shown in FIG. 7. The foot plate 53 is thus slidable relative to the leg plate 51 for movement between a retracted position of FIG. 5 and a projected position in which the lower portion of the foot plate 53 project downwardly from the leg plate 51, at which position the casing 11 can be held on the supporting surface at a larger tilted angle, as shown in FIG. 9. The lower edge of the foot plate 53 is also beveled for stable contact with the supporting surface. A plurality of projections 58 are formed on the back of each tongue 56 so that the foot plate 53, during its sliding movement, can be clicked into selective positions by the hooks 55 being retained behind the corresponding projections 58. With this arrangement, the casing 11 can be placed at a desired tilted position by adjusting the length of the stand 50. The outer face of the foot plate 53 is horizontally knurled as at 59 to facilitate the manipulation thereof.

Figure 11:
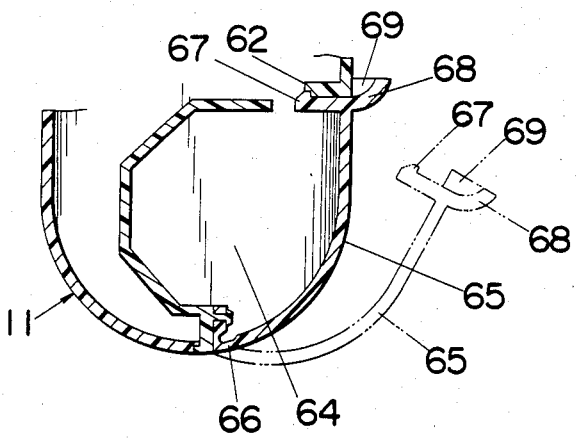
FIG. 11 is an enlarged sectional view showing a battery room with a lid included in the above unit.
Figure 12:
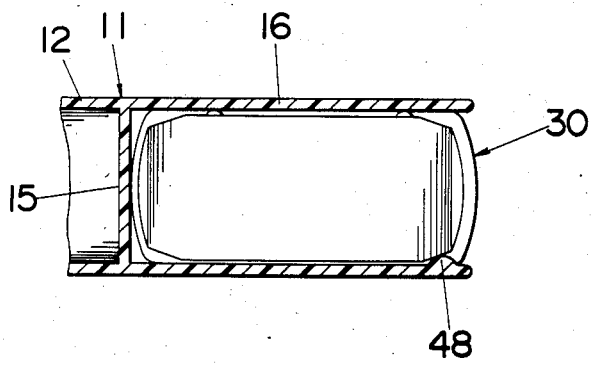
FIG. 12 is a partial sectional view showing a shaver received in a compartment of the above unit.

Said battery room 64 for the clock battery 21 is provided with a lid 65 having the width equal to that of the stand 50 and being located just therebelow. The lid 65 is made of plastic material and has its lower end welded to the bottom edge of the battery room 64, as shown in FIG. 11. Formed adjacent to the welded end of the lid 65 is a thin-walled portion 66 which provides a living hinge permitting pivotal movement of the lid 65 from a closed position indicated by solid lines to an open position indicated by phantom lines of the figure. A catch 67 is formed at the upper edge of the lid 65 to extend inwardly for engagement at 62 with the lower edge of said flange 61 for locking the lid 65 in the closed position. The lid 65 in its closed position has its upper edge in closely adjacent relation with the lower edge of the stand 50 so as not to afford therebetween enough space for inserting a finger of the user trying to open the stand 50. However, a tab 68 formed opposite to the catch 67 on the upper edge of the lid 65 can provide easy access to the lower edge of the stand 50, in addition to the lid 65 itself. That is, the tab 68 extends outwardly to define thereabove a mouth 69 for successfully trapping the tip of the user's finger whereby the user can easily catch the lower edge of the stand 50 in his attempt to open the stand 50.

Figure 13:
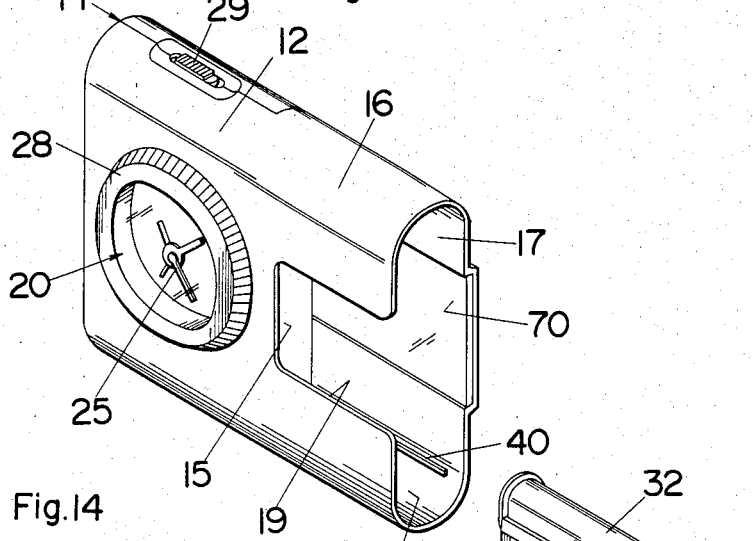
FIG. 13 is a perspective view of a first modification of the first embodiment.

Referring to FIG. 13, first modification of the above embodiment is shown which is identical in construction to the first embodiment except that a mirror 70 is fixed on the interior of the rear wall of the compartment 17 of the casing 11. The mirror 70 is dimensioned to have generally the same length and width as those of the slot 19 formed in the front wall of the compartment 17 so that the mirror surface is fully available through the slot 19.

Figure 14:
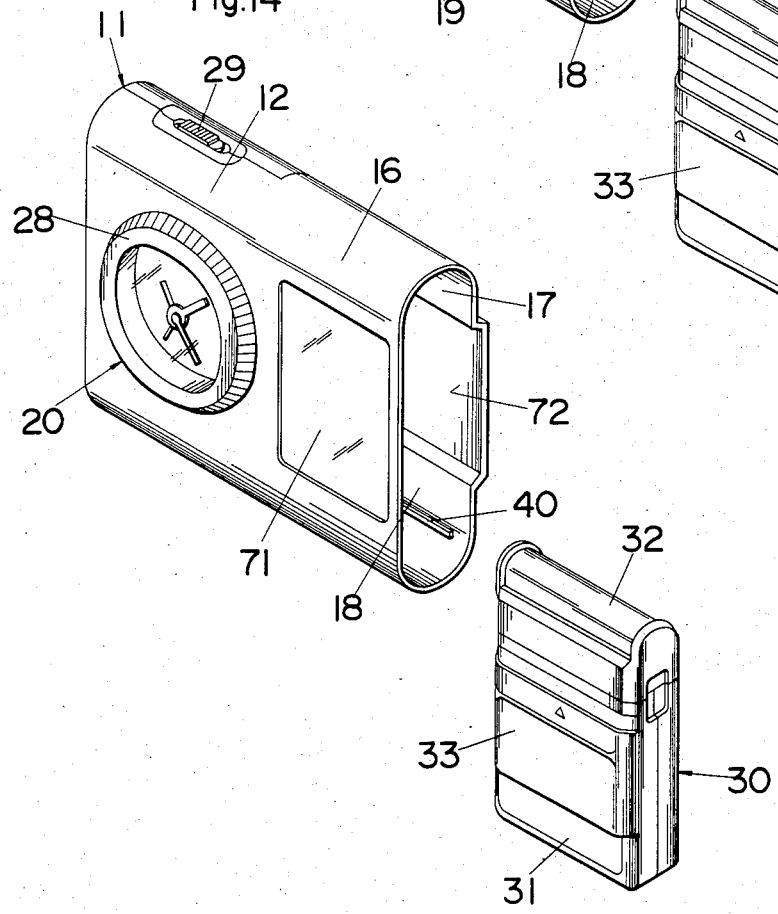
FIG. 14 is a perspective view of a second modification of the first embodiment.

FIG. 14 shows a second modification which is identical in construction to the first embodiment except that a mirror 71 is fixedly mounted on the outer face of the front wall of the compartment 17 of the casing 11. In this modification, no slot is formed in the front wall of the compartment 17, however, a recessed portion 72 is formed in the rear wall of the compartment for receiving the switch handle 33 in a locked manner instead of the slot 19 of the first embodiment. In these figures, the like numerals designates like parts as in the first embodiment.

Figure 15:
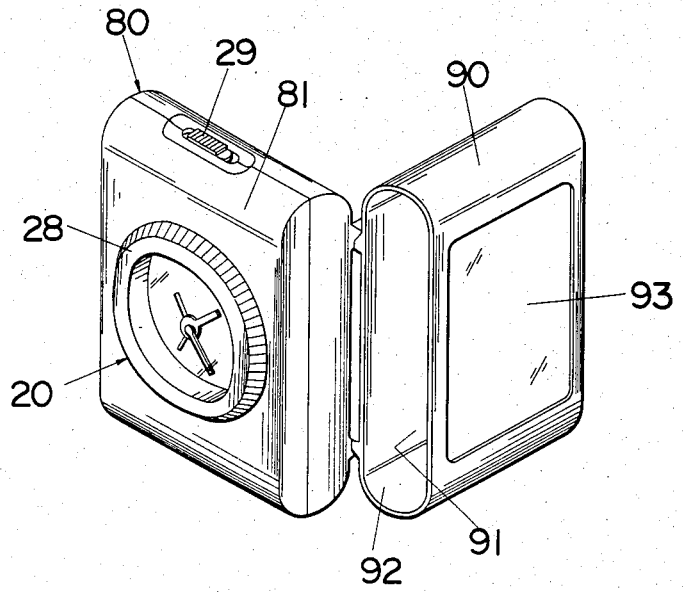
FIG. 15 is a perspective view of a combination clock and shaver unit in accordance with a second embodiment of the present invention.
Figure 16:
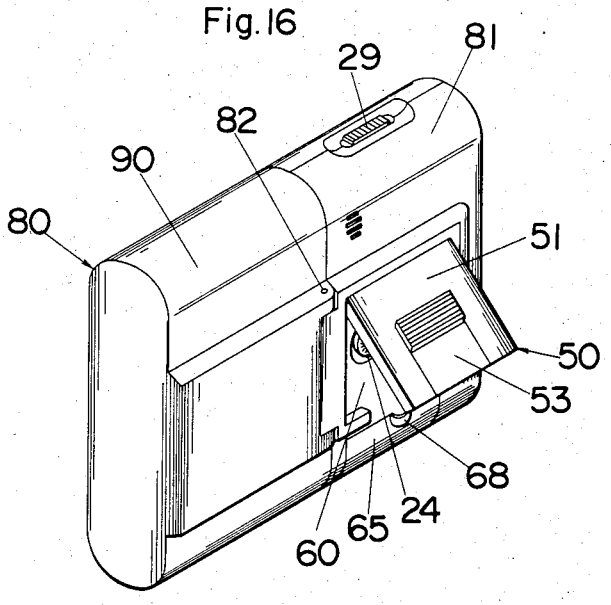
FIG. 16 is a perspective view of the above unit, as viewed from rear.

Referring to FIGS. 15 and 16, there is disclosed a combination clock and shaver unit in accordance with a second embodiment of the present invention. The unit comprises a foldable casing 80 composed of a clock section 81 with the like clock 20 and a shaver holding section 90 with a compartment 91 for removably receiving therein the like shaver, the shaver being of the same construction as in the first embodiment although not shown in the figures. These sections 81 and 90 are separately formed of a plastic material and hingedly connected by means of hinge pins 82, only one of which is shown in FIG. 16, so that they are movable between a straight position in which they are aligned and a folded position where they are folded on each other. The shaver holding section 90 is opened only at its side end adjacent to the clock section 81 to form thereat an entrance opening 92 through which the shaver is received into the compartment 91, said entrance opening 92 being entirely closed by the adjacent side wall of the clock section 81 when the casing 80 is extended to thereby hide the shaver in the casing 80 and protect the shaver from dust or the like undesired foreign matter. In this sense, the compartment 91 can be closed by better utilization of the clock section 81 and without requiring any additional closure cap means which would complicate the assembly of the casing. The above foldable construction of the casing also serves to stably place the casing 80 on the supporting surface since the shaver holding section 90 itself acts as another stand when it is folded at an angle with respect to the clock section 81, as shown in FIG. 15. A mirror 93 is fixed on the outer face of the front wall of the shaver holding section 90. The other constructions are identical to those disclosed in the first embodiment and therefore like numerals are employed to designate like parts.

What is claimed is:

1. An electrically operated clock and shaver combination which comprises:

a casing provided with an electric clock and a battery source therefor;

a self-contained battery powered electric shaver detachably received in a compartment formed in said casing; and said clock and compartment being arranged in side-by-side relation.

2. An electrically operated clock and shaver combination as set forth in claim 1, wherein said casing is formed at its end opposite to the clock with an entrance opening through which the shaver is received into the compartment.

3. An electrically operated clock and shaver combination as set forth in claim 1, wherein said compartment is formed with a slot into which a switch handle of the shaver is fitted so that it is locked at its inoperative position and prevented from moving into its operative position of driving the shaver.

4. An electrically operated clock and shaver combination as set forth in claim 1, wherein a telescopic stand is pivotally connected to said casing for movement between a folded position where it is folded on the casing and an extended position where it extends angularly away from the casing.

5. An electrically operated clock and shaver combination as set forth in claim 1, wherein a stand is pivotally connected to said casing for movement between a folded position where it is folded on the casing and an extended position where it extends angularly away from the casing and wherein the casing includes in its lower portion a battery room with a lid for said battery source of the clock, said lid having its upper edge in closely adjacent relation to the lower edge of said stand in its folded position and being provided at its upper edge with a manipulation tab for opening the lid, said tab extending outwardly and rearwardly of the casing to define between the tab and the lower edge of the folded stand a mouth for easy insertion of the tip of a finger of the user attempting to manipulate the stand into the extended position.

6. An electrically operated clock and shaver combination as set forth in claim 1, wherein said compartment is provided on the interior of the rear wall of the casing with a mirror which is viewed through a slot formed in the opposed front wall of the casing.

7. An electrically operated clock and shaver combination as set forth in claim 1, wherein said casing is provided on its front face with a mirror.

8. An electrically operated clock and shaver combination as set forth in claim 1, wherein said casing is divided into a clock section and a shaver holding section, said clock section including said clock and the battery source therefor, said shaver section forming therein said compartment for receiving the shaver, said two sections being connected at the side ends thereof through a hinge so as to allow one of the sections to be folded on the other section.

9. An electrically operated clock and shaver combination as set forth in claim 8, wherein said shaver holding section has an entrance opening in the hinged side end thereof, which is closed by the adjacent side end of the clock section when the two sections are extended into a straight position where they are in alignment relation with each other.

* * * * *